US005771965A

United States Patent [19]

Inaba et al.

[11] Patent Number: 5,771,965

[45] Date of Patent: Jun. 30, 1998

[54] HEADER PIPE FOR HEAT EXCHANGER

[75] Inventors: Hiroyuki Inaba, Tokyo; Ryuji Yasuda, Kanagawa, both of Japan

[73] Assignee: Calsonic Corporation, Tokyo, Japan

[21] Appl. No.: 757,093

[22] Filed: Dec. 2, 1996

[30] Foreign Application Priority Data

Dec. 12, 1995 [JP] Japan ..... 7-322769

[51] Int. Cl.[6] ..... F28F 9/04

[52] U.S. Cl. ..... 165/178; 285/122.1; 285/188

[58] Field of Search ..... 165/178, 173, 165/175; 285/188, 122.1; 29/890.043, 890.052

[56] References Cited

U.S. PATENT DOCUMENTS 2,082,584 6/1937 Magis ..... 29/890.043 X

FOREIGN PATENT DOCUMENTS

| | | | |
|---|---|---|---|
| 112656 | 11/1991 | Japan . | |
| 203690 | 7/1992 | Japan | 285/188 |
| 862168 | 3/1961 | United Kingdom | 29/890.052 |
| 1304278 | 1/1973 | United Kingdom | 285/188 |

*Primary Examiner*—Leonard R. Leo
*Attorney, Agent, or Firm*—Sughrue, Mion, Zinn, Macpeak & Seas, PLLC

[57] ABSTRACT

In a header pipe for use in a heat exchanger composed of a header pipe body, both ends of which are closed, and a heating medium pipe, one end of which is connected to the header pipe body, on an outer circumferential surface of the header pipe body, there is formed a connecting opening which is open in an axial direction of the header pipe body, and one end portion of the heating medium pipe is inserted into the connecting opening.

10 Claims, 5 Drawing Sheets

HEADER PIPE FOR HEAT EXCHANGER

BACKGROUND OF THE INVENTION

The present invention relates to a header pipe for use in a heat exchanger.

A conventional condenser to liquidize a refrigerant in an air conditioner is disclosed, for example, in Japanese Utility Model Publication No. Hei. 3-112656.

FIG. 6 is an arrangement view showing a header pipe of this type of condenser. In FIG. 6, the reference numeral 11 is a cylindrical header pipe body made of aluminum, both ends of which are closed.

On an outer circumferential surface of the lower end portion of this header pipe body 11, there is formed a connecting opening 13 which is open in a direction perpendicular to the axial direction of the header pipe body 11.

The reference numeral 15 is a refrigerant pipe made of aluminum.

At a lower end portion of this refrigerant pipe 15, there are formed bent portions 15*a*, 15*b*, 15*c* which are bent by a predetermined radius of curvature. Further, on an outer circumferential surface of this refrigerant pipe 15 on the lower end side, there is formed a bead portion 15*d*.

The bead portion 15*d* comes into contact with the outer circumferential surface of the header pipe 11, and an end portion of the refrigerant pipe 15 is inserted into the connecting opening 13.

The refrigerant pipe 15 is connected perpendicularly to the axial direction H of the header pipe body 11 and fixed to the header pipe body 11 by means of soldering.

An upper end portion of the refrigerant pipe 15 is arranged along the outer circumferential surface of the header pipe body 11.

However, in the case of the above conventional header pipe for use in a heat exchanger, the refrigerant pipe 15 is fixed to the header pipe body 11 in a direction perpendicular to the axial direction H of the header pipe body 11. Accordingly, a clearance W formed between the header pipe body 11 and the refrigerant pipe 15 is increased. As a result, the refrigerant pipe 15 greatly protrudes in the transverse direction. In this case, there is a possibility that the refrigerant pipe 15 interferes with other members. In this way, restrictions are placed on the layout of the header pipe by the protruding refrigerant pipe 15.

That is, since the refrigerant pipe 15 is fixed to the header pipe body 11 in a direction perpendicular Lo the axial direction H of the header pipe body 11, it is necessary to increase the bend angles of the bent portions 15*a*, 15*b*, 15*c* of the refrigerant pipe 15. However, when the radii of curvature of the bent portions 15*a*, 15*b*, 15*c* are reduced, cracks may be caused on the outer circumferential surface of the bent portions 15*a*, 15*b*, 15*c*. For this reason, the radii of curvature of the bent portions 15*a*, 15*b*, 15*c* are necessarily increased. As a result, the clearance W formed between the header pipe body 11 and the refrigerant pipe 15 is increased.

SUMMARY OF THE INVENTION

The present invention has been accomplished to solve the above conventional problems. It is an object of the present invention to provide a header pipe for use in a heat exchanger in which a clearance formed between the header pipe body and the heating medium pipe can be easily reduced.

According to the present invention, there is provided a header pipe for a heat exchanger comprising: a header pipe body; and a heating medium pipe, a first end thereof being connected with the header pipe body; wherein a connecting opening is formed on an outer circumferential surface of the header pipe body so as to be open in an axial direction of the header pipe body, and the first end of the heating medium pipe is inserted into and connected with the connecting opening.

The header pipe in the present invention may also include a semicircular engaging protrusion formed in an inner part of the connecting opening into which the first end of the heating medium pipe is inserted, the semicircular engaging protrusion protruding outside from the outer circumferential surface of the header pipe body; and a semicircular engaging recess formed in an outer part of the connecting opening into which a portion adjacent to the first end of the heating medium pipe is inserted, the semicircular engaging recess protruding inside from the outer circumferential surface of the header pipe body.

Further, in the header pipe according to the present invention, the header pipe body and heating medium pipe may be made of aluminum, and the heating medium pipe is fixed to the connecting opening of the header pipe body by soldering.

In the header pipe for use in a heal exchanger described in the first aspect of the invention, on the outer circumferential surface of the header pipe body, there is formed a connecting section having a connecting opening which is open in the axial direction of the header pipe body, and one end portion of the heating medium pipe is connected to this connecting section without being greatly bent.

In the header pipe for use in a heat exchanger described in the second aspect of the invention, a semicircular engaging protrusion and a semicircular engaging recess, into which an end portion of the heating medium pipe is inserted, are integrally formed in the heating pipe body, so that a contact area of the header pipe body with the heating medium pipe can be increased.

In the header pipes for use in a heal exchanger described in the above, both the header pipe body and the heating medium pipe are made of aluminum, and the heating medium pipe is positively fixed to the header pipe body by means of soldering.

DETAILED DESCRIPTION OF THE PREFERRED EMBODIMENTS

Referring to the accompanying drawings, an embodiment of the present invention will be explained as follows.

Figure 1:
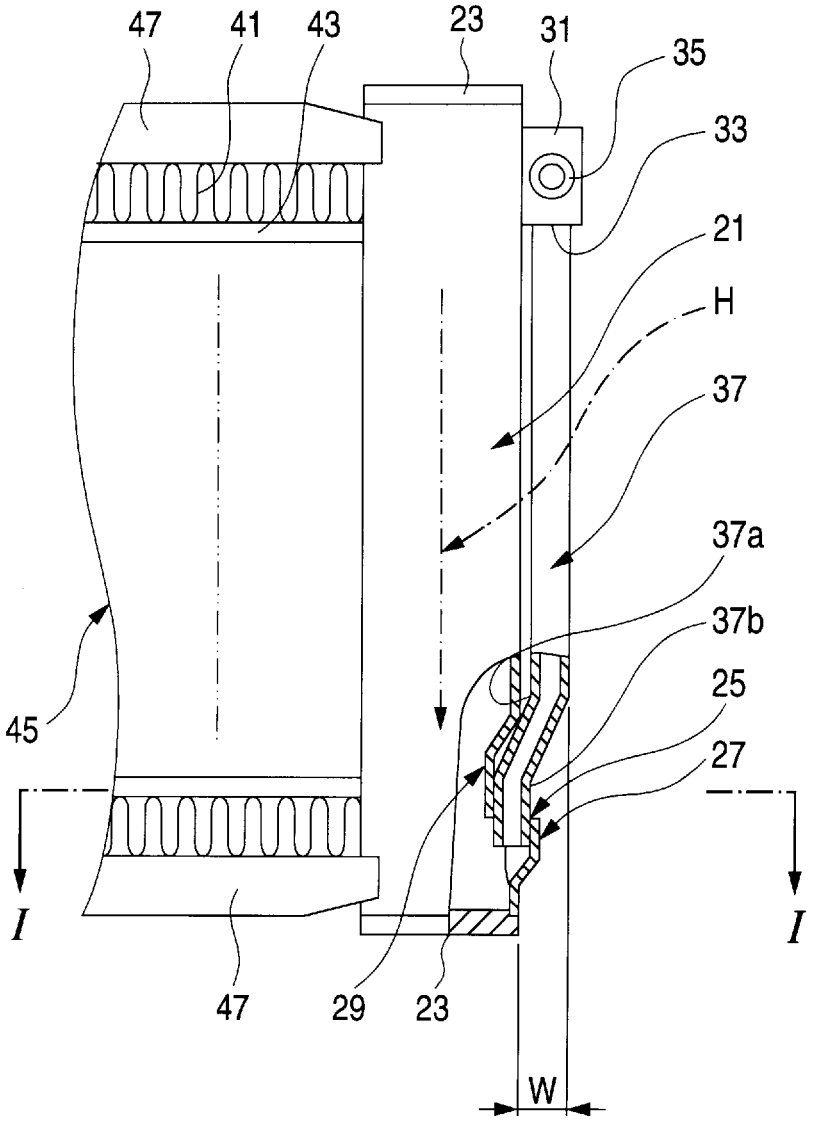
FIG. 1 is a front view showing an embodiment of the header pipe for a heat exchanger of the present invention.

FIG. 1 is a front view showing an embodiment of the header pipe for use in a heat exchanger of the present invention.

This header pipe for a heat exchanger is used as a header pipe of a condenser in which a refrigerant, of an airconditioner incorporated into an automobile is condensed.

In the drawing, the reference numeral 21 is a cylindrical pipe body made of aluminum, both ends of which are open.

At both ends of this pipe body 21, there are provided patch ends 23 made of aluminum.

The header pipe body 21 and patch ends 23 are fixed to each other by means of soldering.

On an outer circumferential surface of the lower end of th header pipe body 21, there is formed a connecting opening 25 which is open in the axial direction H of the header pipe body 21.

In an inner part of the connecting opening 25 of the header pipe body 21, there is integrally formed a semicircular engaging protrusion 27 which protrudes outside.

In an outer part of the connecting opening 25 of the header pipe body 21, there is integrally formed a semicircular engaging recess 29 which protrudes inside.

On an outer circumferential surface of the header pipe body 21 at the upper end, there is provided a pipe connecting member 31 made of aluminum, which is fixed to the header pipe body 21 by means of soldering.

On a lower surface of this pipe connecting member 31, there is formed a connecting opening 33 which is opposed to the connecting opening 25.

On a front surface of the pipe connecting member 31, there is formed a pipe connecting opening 35. The connecting opening 33 and the pipe connecting opening 35 are communicated with each other inside the pipe connecting member 31.

On an outer circumferential surface of the header pipe body 21, there is provided a heating medium pipe 37 made of aluminum, both ends of which are open.

At a lower end portion of this heating medium pipe 37, there are provided a bent portion 37*a* which is bent inside and a bent portion 37*b* which is bent outside.

Figure 2:
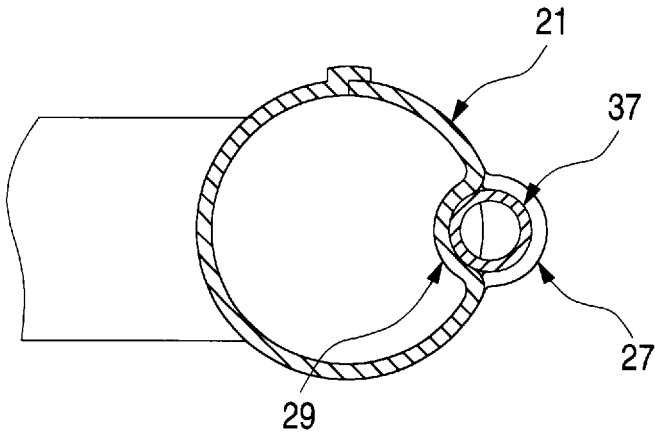
FIG. 2 is a cross-sectional view taken along line I–I in FIG. 1.

A lower end portion of this heating medium pipe 37 is inserted into the connecting opening 25. As shown in FIG. 2, the lower end portion of this heating medium pipe 37 is interposed between and held by the engaging protrusion 27 and the engaging recess 29 and fixed to the header pipe body 21 by means of soldering.

An upper end portion of the heating medium pipe 37 is inserted into the connecting opening 33 of the pipe connecting member 31 and fixed to the pipe connecting member 31.

In this connection, in the header pipe body 21, there is provided a core portion 45 composed of aluminum tubes 43 and fins 41. Reinforcing members 47 are arranged in an upper and lower portions of this core portion 45. These members are fixed to the header pipe body 21 by means of soldering.

Figure 3:
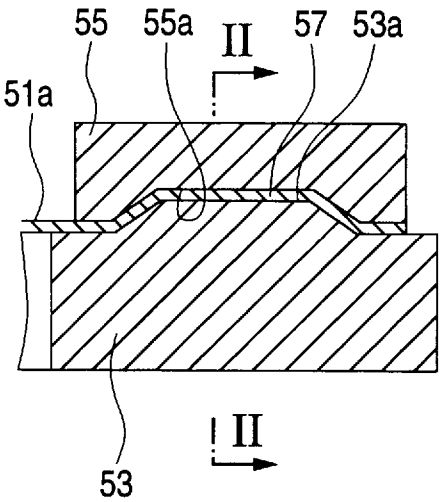
FIGS. 3(*a*) and 3(*b*) are cross-sectional views showing a manufacturing method of the header pipe body Shown in FIG. 1, FIG. 3(*a*) being a cross-sectional view taken along line II–II in FIG. 3(*b*)
Figure 3:
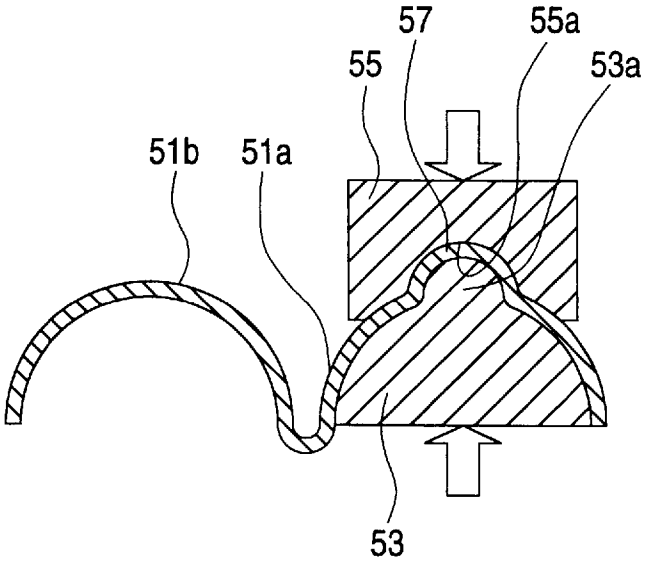
Figure 4:
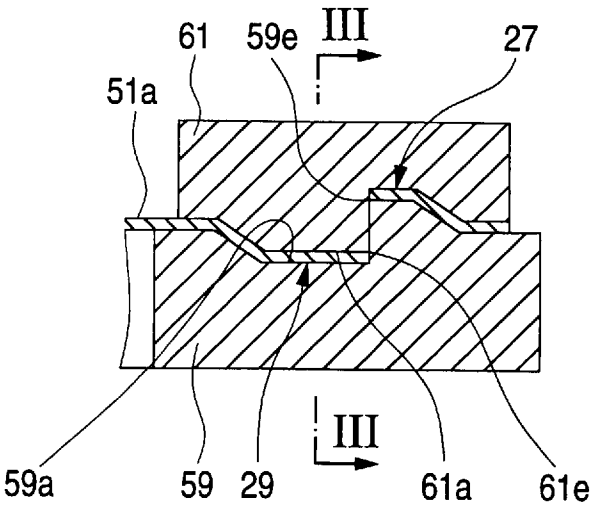
FIGS. 4(*a*) and 4(*b*) are cross-sectional views showing a manufacturing method of the header pipe body following to FIGS. 3(*a*) and 3(*b*), FIG. 4(*a*) being a cross-sectional view taken along line III–III in FIG. 4(*b*)
Figure 4:
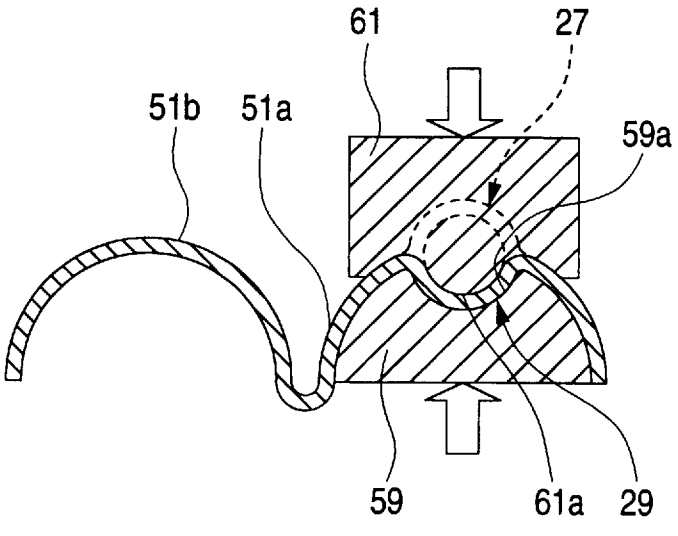

FIGS. 3(*a*) and 3(*4*), and FIGS. 4(*a*) and 4(*b*) are cross-sectional views showing a method of manufacturing the above header pipe body 21. Particularly, a method of manufacturing the engaging protrusion 27 and engaging recess 29, which are formed integrally with the header pipe body 21, is shown in detail in the cross-sectional views of FIGS. 3(*a*), 3(*b*), 4(*a*) and 4(*b*).

In this embodiment, the header pipe body 21 is manufactured in such a manner that semicircular cylindrical sections 51*a*, 51*b* are integrally formed on one metallic sheet in parallel to each other and then the thus formed semicircular cylindrical sections 51*a*, 51*b* are butted being opposed to each other.

Then, the engaging protrusion 27 and the engaging recess 29 are integrally formed under the condition that the semicircular cylindrical sections 51*a*, 51*b* are open to each other.

As shown in FIGS. 3(*a*) and 3(*b*), the semicircular portion 51*a* is interposed between the first inner press metallic die 53 and the first outer press metallic die 55.

Next, by a metallic die drive means such as a hydraulic cylinder not shown in the drawing, the inner press metallic die 53 and the outer press metallic die 55 are gradually driven inside, so that a clearance between the two metallic dies is reduced.

Then a portion of the semicircular cylindrical section 51*a* is extended by the action of a semicircular protrusion 53*a* of the inner press metallic die 53 and a semicircular recess 55*a* of the outer press metallic dies 55 which are arranged opposed to each other.

After the completion of driving the inner press metallic die 53 and the outer press metallic die 55, a semicircular protrusion 57 protruding outside is formed on the outer circumferential surface of the semicircular cylindrical section 51*a*.

Next, as shown in FIGS. 4(*a*) and 4(*b*), the semicircular cylindrical section 51*a* in which the semicircular protrusion 57 is formed is interposed between the second inner press metallic die 59 and the second outer press metallic die 61 which are arranged being opposed to each other.

Next, by a metallic die drive means such as a hydraulic cylinder not shown in the drawing, the inner press metallic die 59 and the outer press metallic die 61 are gradually driven inside, so that a clearance between the two metallic dies is reduced.

Then a portion close to the center of the semicircular protrusion 57 formed in the semicircular cylindrical section 51*a* starts being cut by an edge portion 59*e* of the inner press metallic die 59 and an edge portion 61*e* of the outer press metallic die 61 which are arranged being opposed to each other.

Simultaneously when the semicircular protrusion 57 is cut, the semicircular protrusion 57 formed in the semicircular cylindrical section 51*a* starts expanding inside by a semicircular recess 59*a* of the inner press metallic die 59 and a semicircular protrusion 61*a* of the outer press metallic die 61 which are arranged being opposed to each other.

Finally, after the completion of driving the inner press metallic die 59 and the outer press metallic die 61, a semicircular cylindrical engaging protrusion 27 protruding outside and a semicircular cylindrical engaging recess 29 protruding inside are formed on the outer circumferential surface of the semicircular protrusion 57.

To the above header pipe for use in a heat exchanger, the heating medium pipe 37 having bent portions is strongly fixed as follows. Under the condition that the lower end portion of the heating medium pipe 37, which has the bent portion 37*a* gradually bent inside and the bent portion 37*b* gradually bent outside, is inserted into the connecting opening 25 open in the axial direction H of the header pipe body 21 which is formed on the outer circumferential surface of the header pipe body 31, these members are fixed with a jig. Then, the connecting opening 25 and the heating medium pipe 37 are strongly fixed to each other by means of soldering conducted in a vacuum disclosed in Japanese Patent Publication No. Hei. 7-314035 applied by the present applicant on Mar. 29, 1994 or alternatively by means of soldering in an atmosphere of inert gas while uncorrosive flux is coated on the soldering portion or in an atmosphere of nitrogen gas.

In the header pipe for use in a heat exchanger composed as described above, there is formed a connecting opening 25 which is open in the axial direction H on the outer circumferential surface of the header pipe body 21. Accordingly, one end of the heating medium pipe 37 can be connected to this connecting opening 25 without greatly bending the heating medium pipe 37. Therefore, it is possible to reduce a clearance W formed between the header pipe body 21 and the heating medium pipe 37.

Consequently, even when the heat exchanger is placed in a small engine chamber of an automobile, each component can be effectively laid out.

In the header pipe for use in a heat exchanger composed as described above, there are integrally provided a semicircular engaging protrusion 27 and a semicircular engaging recess 29, to which the lower end portion of the heating medium pipe 37 is fixed, in the header pipe body 21. Accordingly, a soldering surface contact area of the header pipe 21 with the heating medium pipe 37 is increased, so that the header pipe body 21 and the heating medium pipe 37 can be positively connected to each other.

Since the soldering surface area of the header pipe body 21 with the heating medium pipe 37 is increased, it is possible to omit the formation of a bead portion in the heating medium pipe which has been conventionally provided to increase the soldering surface area between the header pipe and the heating medium pipe. Therefore, it is possible to greatly save time and labor in the manufacturing process of a heat exchanger, and the manufacturing cost can be easily reduced.

In the above header pipe for use in a heat exchanger, since the connecting opening 25 is formed on the outer circumferential surface of the lower end portion of the header pipe body 21, when the condenser is perpendicularly arranged, a condensed refrigerant staying in the lower end portion of the header pipe body 21 can be effectively circulate.

Further, in the above header pipe for use in a heat exchanger, since the header pipe body 21 and the heating medium pipe 37 are made of aluminum and fixed to each other by means of soldering, the heating medium pipe 37 can be positively and easily fixed to the header pipe 21.

Figure 5:
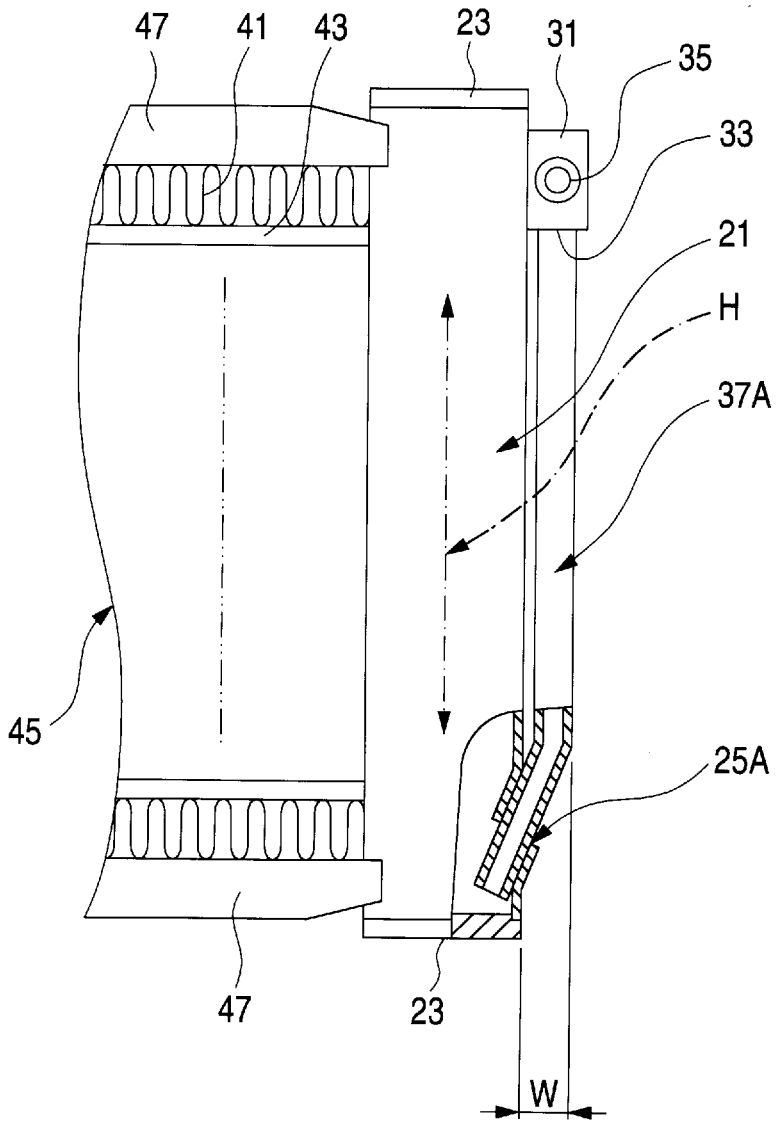
FIG. 5 is a front view showing another embodiment of the header pipe for a heat exchanger of the present invention.
Figure 6:
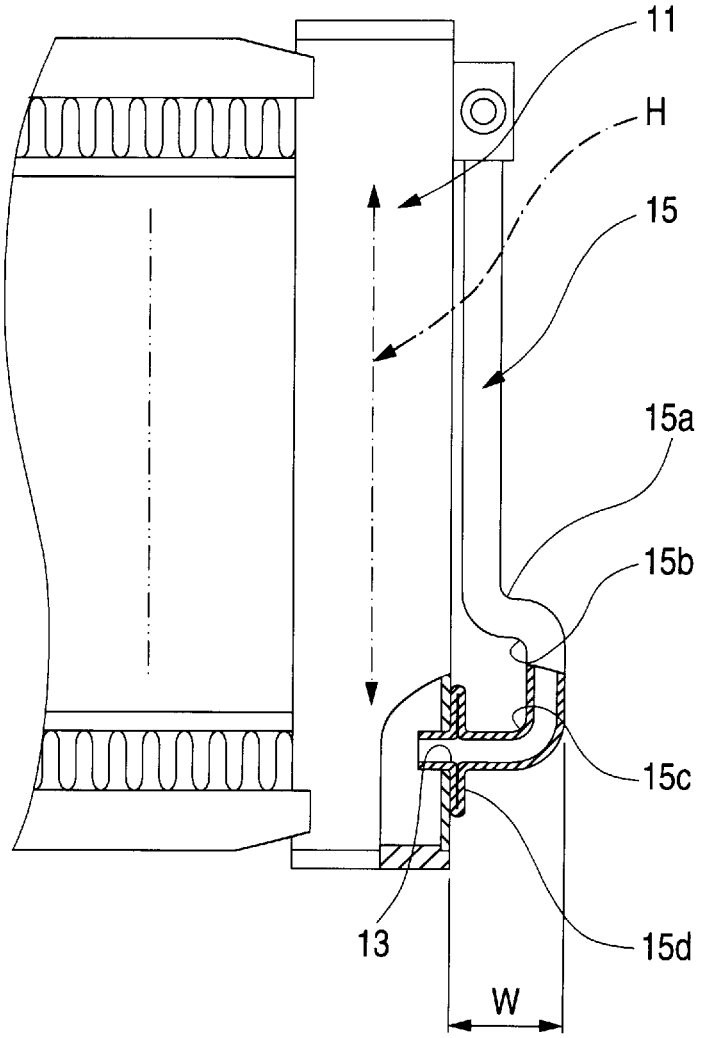
FIG. 6 RELATED ART
FIG. 6 is a front view showing an example of the conventional header pipe for a heat exchanger.

In the embodiment described above, the connecting opening 25 is open in the axial direction H of the header pipe body 21. However, it should be noted that the present invention is not limited to the above specific embodiment. For example, as shown in FIG. 5, a connecting opening 25A may be a little inclined outside with respect to the axial direction H of the header pipe body 21, and a heating medium pipe 37A, the lower end of which is bent inside, may be connected to this connecting opening 25A.

In the above embodiment, the header pipe body 21 is manufactured in such a manner that semicircular cylindrical sections 51*a*, 51*b* are integrally formed on one metallic sheet in parallel to each other and then the thus formed semicircular cylindrical sections 51*a*, 51*b* are butted being opposed to each other. However, it should be noted that the present invention is not limited to the above specific embodiment. Two independent semicircular cylindrical members may be butted to each other to form the header pipe body 21.

In the above embodiment, the header pipe is used for a heat exchanger of an air-conditioner for automobile use. However, it should be noted that the present invention is not limited to the above specific embodiment. The present invention can be applied to other types of heat exchangers.

In the above embodiment, the header pipe 21 and the heating medium pipe 37 are made of aluminum. However, it should be noted that the present invention is not limited to the above specific embodiment. The header pipe 21 and the heating medium pipe 37 may be made of copper alloy and others.

In the above embodiment, in the header pipe body 21, there are provided no partition plates. However, it should be noted that the present invention is not limited to the above specific embodiment. Partition plates may be arranged in the header pipe body 21.

In the above embodiment, the cylindrical header pipe body 21 is used. However, it should be noted that the present invention is not limited to the above specific embodiment. Any appropriate shape may be adopted for the header pipe body 21 in accordance with the circumstances of use of the header pipe.

In the above embodiment, the header pipe body 21 and the heating medium pipe 37 are fixed to each other by means of soldering. However, it should be noted that the present invention is not limited to the above specific embodiment. The header pipe body 21 and the heating medium pipe 37 may be fixed to each other by means of welding such as argon arc welding.

In the above embodiment, the header pipe body 21 and the heating medium pipe 37 are made of aluminum. However, it should be noted that the present invention is not limited to the above specific embodiment. The header pipe body 21 and the heating medium pipe 37 may be made of clad material in which a soldering material layer is formed on an aluminum sheet.

Furthermore, it is to be understood that the foregoing description and the accompanying drawings are not intended to limit the scope of this invention, rather, various modifications or variations may be made by those of ordinary skilled in the art without departing from the scope of this invention which is defined by the appended claims.

What is claimed is:

1. A header pipe for a heat exchanger comprising:

a header pipe body; and a heating medium pipe, and first end thereof being connected with said header pipe body;

wherein a connecting opening is formed on an outer circumferential surface of said header pipe body so as to be open in an axial direction of said header pipe body, said connecting opening protruding within and reducing a diameter of said header pipe body, and said first end of said heating medium pipe is inserted into and connected with said connecting opening.

2. The header pipe for a heat exchanger according to claim 1, wherein said header pipe body and heating medium pipe are made of aluminum, and said heating medium pipe is fixed to said connecting opening of said header pipe body by soldering.

3. The header pipe for a heat exchanger according to claim 1, wherein both ends of said header pipe body are closed.

4. The header pipe for a heat exchanger according to claim 1, further comprising a pipe connecting member which is fixed to said header pipe body and connected to a second end of said heating medium pipe.

5. The header pipe for a heat exchanger according to claim 1, wherein said header pipe body and heating medium pipe are made of copper alloy, and said heating medium pipe is fixed to said connecting opening of said header pipe body by soldering.

6. The header pipe for a heat exchanger according to claim 1, wherein said header pipe body and heating medium pipe are made of clad materal in which a soldering material layer is formed on an aluminum sheet, and said heating medium pipe is fixed to said connecting opening of said header pipe body by soldering.

7. A header pipe for a heat exchanger comprising:

a header pipe body;

a heating medium pipe, and first end thereof being connected with said header pipe body;

wherein a connecting opening is formed on an outer circumferential surface of said header pipe body so as to be open in an axial direction of said header pipe body, and said first end of said heating medium pipe is inserted into and connected with said connecting opening;

a semicircular engaging protrusion formed in an inner part of said connecting opening into which said first end of said heating medium pipe is inserted, said semicircular engaging protrusion protruding outside from said outer circumferential surface of said header pipe body; and a semicircular engaging recess formed in an outer part of said connecting opening into which a portion adjacent to said first end of said heating medium pipe is inserted, said semicircular engaging recess protruding inside from said outer circumferential surface of said header pipe body.

8. The header pipe for a heat exchanger according to claim 7, wherein said header pipe body and heating medium pipe are made of aluminum, and said heating medium pipe is fixed to said connecting opening of said header pipe body by soldering.

9. The header pipe for a heat exchanger according to claim 7, wherein inside and outside bent portions are formed at said first end of said heating medium pipe, and a substantial portion of said first end is interposed between and held by said semicircular engaging protrusion and engaging recess.

10. A header pipe for a heat exchanger comprising:

a header pipe body;

a heating medium pipe, and first end thereof being connected with said header pipe body;

wherein a connecting opening is formed on an outer circumferential surface of said header pipe body so as to be open in an axial direction of said header pipe body, and said first end of said heating medium pipe is inserted into and connected with said connecting opening; and wherein said connecting opening is formed on said outer circumferential surface of said header pipe body so as to be open in a little inclined direction outside with respect to an axial direction of said header pipe body, and said first end of said heating medium pipe is bent inside.

* * * * *